US009950415B2

(12) United States Patent
Takeuchi et al.

(10) Patent No.: US 9,950,415 B2
(45) Date of Patent: Apr. 24, 2018

(54) IMPACT TOOL

(71) Applicant: MAKITA CORPORATION, Anjo-shi, Aichi (JP)

(72) Inventors: Hajime Takeuchi, Anjo (JP); Kei Watanabe, Anjo (JP); Masanori Furusawa, Anjo (JP)

(73) Assignee: MAKITA CORPORATION, Anjo-shi (JP)

( * ) Notice: Subject to any disclaimer, the term of this patent is extended or adjusted under 35 U.S.C. 154(b) by 467 days.

(21) Appl. No.: 14/665,582

(22) Filed: Mar. 23, 2015

(65) Prior Publication Data

US 2015/0266176 A1 Sep. 24, 2015

(30) Foreign Application Priority Data

Mar. 24, 2014 (JP) ..... 2014-059878

(51) Int. Cl.

| | |
|---|---|
| ***B25D 11/00*** | (2006.01) |
| ***B25D 17/04*** | (2006.01) |
| ***B25D 17/20*** | (2006.01) |
| ***B25D 17/24*** | (2006.01) |

(52) U.S. Cl.

CPC ..... *B25D 11/00* (2013.01); *B25D 17/043* (2013.01); *B25D 17/20* (2013.01); *B25D 17/24* (2013.01); *B25D 2211/003* (2013.01); *B25D 2211/068* (2013.01); *B25D 2217/0088* (2013.01); *B25D 2217/0092* (2013.01);

(Continued)

(58) Field of Classification Search

CPC ..... B25D 11/00; B25D 16/00; B25D 17/04
USPC ..... 173/104, 109, 201, 162.1, 162.2
See application file for complete search history.

(56) References Cited

U.S. PATENT DOCUMENTS

| | | | | |
|---|---|---|---|---|
| 7,987,921 | B2 * | 8/2011 | Hahn | B25D 17/043 173/162.1 |
| 2003/0070823 | A1 * | 4/2003 | Kristen | B25D 17/20 173/217 |
| 2004/0154813 | A1 | 8/2004 | Daubner et al. | |

(Continued)

FOREIGN PATENT DOCUMENTS

| | | |
|---|---|---|
| EP | 1637288 A1 | 3/2006 |
| EP | 2100698 A2 | 9/2009 |

(Continued)

OTHER PUBLICATIONS

Jul. 23, 2015, The extended Search Report issued in European Patent Application No. 15160329.7.

(Continued)

*Primary Examiner* — Nathaniel Chukwurah
(74) *Attorney, Agent, or Firm* — Oliff PLC

(57) ABSTRACT

The representative impact tool has a motor, a driving mechanism, a body housing and a handle, and part of the motor and part of the handle are disposed on an axis of a tool accessory. The impact tool has an outer housing that is disposed to cover the outside of the body housing and connected to the body housing via an elastic element so as to be allowed to move with respect to the body housing in an axial direction of the tool accessory, and the handle is integrally connected to the outer housing. The body housing has an exposed region in which at least part of a region of the body housing corresponding to at least one of the motor and the driving mechanism, is not covered by the outer housing.

15 Claims, 8 Drawing Sheets

(52) U.S. Cl.
CPC .. *B25D 2250/065* (2013.01); *B25D 2250/121* (2013.01); *B25D 2250/371* (2013.01)

(56) References Cited

U.S. PATENT DOCUMENTS

| | | | | |
|---|---|---|---|---|
| 2009/0223691 | A1* | 9/2009 | Ikuta | B25D 17/24 173/117 |
| 2012/0279740 | A1 | 11/2012 | Furusawa et al. | |
| 2012/0305277 | A1* | 12/2012 | Ikuta | B25D 17/24 173/162.1 |

FOREIGN PATENT DOCUMENTS

| | | | |
|---|---|---|---|
| EP | 2468455 | A1 | 6/2012 |
| JP | 2004-174707 | A | 6/2004 |
| JP | 2009-208208 | A | 9/2009 |
| JP | 2011-131364 | A | 7/2011 |
| WO | 2013/061835 | A1 | 5/2013 |

OTHER PUBLICATIONS

Jul. 5, 2017 Office Action issued in Japanese Patent Application No. 2014-059878.

* cited by examiner

IMPACT TOOL

TECHNICAL FIELD

The invention relates to an impact tool which performs a prescribed hammering operation on a workpiece.

BACKGROUND ART

Japanese Unexamined Patent Application Publication (JP-A) No. 2004-174707 discloses an electric hammer in which part of each of an electric motor for driving a tool accessory and a handle is disposed on an axis of the tool accessory. Further, in this electric hammer, an outer housing integrally formed with the handle is configured to entirely cover an inner housing that houses the electric motor and a driving mechanism part.

PRIOR ART DOCUMENT

Patent Document

Patent Document 1: JP-A No. 2004-174707

SUMMARY OF THE INVENTION

According to the electric hammer described in JP-A No. 2004-174707, the whole inner housing that houses the electric motor and the driving mechanism part is covered by the outer housing, so that it is difficult to cool the motor or the driving mechanism part. In this point, further improvement is desired.

Accordingly, it is an object of the invention to provide an impact tool improved in cooling performance for cooling a motor or a driving mechanism part.

The above-described problem can be solved by a preferred aspect of a representative impact tool according to the invention. The representative impact tool is provided which has a motor, a driving mechanism, a body housing and a handle, and part of the motor and part of the handle are disposed on an axis of the tool accessory. The driving mechanism is driven by the motor and drives a tool accessory at least in an axial direction of the tool accessory, and the body housing houses the motor and the driving mechanism. The impact tool has an outer housing that is disposed to cover the outside of the body housing, and an elastic element that is disposed between the body housing and the outer housing. The outer housing is mounted to the body housing via the elastic element so as to be allowed to move with respect to the body housing in the axial direction of the tool accessory. The handle is integrally connected to the outer housing. The body housing has an exposed region in which at least part of a region of the body housing corresponding to at least one of the motor and the driving mechanism is not covered by the outer housing. The "exposed region" may include an exposed region in which a part or the whole of a region of the body housing corresponding to the motor is exposed, an exposed region in which a part or the whole of a region of the body housing corresponding to the driving mechanism is exposed, and an exposed region in which a part or the whole of a region of the body housing corresponding to the motor and the driving mechanism is exposed. Further, the "driving mechanism" may include a motion converting mechanism that converts rotation of the motor into linear motion, and a striking mechanism that is linearly driven by the motion converting mechanism and strikes the tool accessory in the axial direction. As an example of the "elastic element", a spring may typically be used, but a rubber may also be used.

According to the representative impact tool in which part of each of the motor and the handle is disposed on the axis of the tool accessory, the body housing has the exposed region in which at least part of the region of the body housing corresponding to at least one of the motor and the driving mechanism is not covered by the outer housing. By provision of the exposed region in the body housing, heat which is generated when the motor and the driving mechanism are driven is easily dissipated to the outside through the exposed region, so that the cooling performance of the impact tool is improved.

According to a preferred aspect of the impact tool, the exposed region of the body housing has an outer surface region which is formed flush with an outer surface of the outer housing. The "outer surface region" here may be formed over the whole exposed region or in part thereof. Further, a heat dissipation fin can be provided in the exposed region. In such a case, a front end of the fin is preferably configured to be flush with the outer surface of the outer housing.

According to this aspect, by provision of the structure in which the exposed region of the body housing has the outer surface region which is formed flush with the outer surface of the outer housing, the outer surface having a large area is formed, so that an excellent appearance can be obtained.

According to a further aspect of the representative impact tool, part of the outer housing can be removed from the body housing, and a region of the body housing other than the exposed region is exposed by removing this part of the outer housing.

According to this aspect, provision of the structure in which part of the outer housing can be removed from the body housing and a region of the body housing other than the exposed region is exposed by removing the part of the outer housing is effective and advantageous in performing maintenance check of the motor, the driving mechanism and their related parts which are housed in the body housing.

According to a further aspect of the representative impact tool, the outer housing has a first housing and a second housing formed separately from the first housing, and at least one of the first housing and the second housing is removably connected to the body housing.

According to this aspect, when at least one of the first housing and the second housing is removed from the body housing, the body housing is exposed, so that maintenance check of the motor, the driving mechanism and their related parts in the body housing can be performed.

According to a further aspect of the representative impact tool, the driving mechanism has a motion converting mechanism that converts rotation of the motor into linear motion. The motion converting mechanism has a rotation transmitting mechanism that transmits rotation of the motor to a rotation axis of the motion converting mechanism. The rotation transmitting mechanism typically comprises a plurality of gears. The body housing has a motion converting mechanism housing part that houses the motion converting mechanism, and a rotation transmitting mechanism housing part that houses the rotation transmitting mechanism. The motion converting mechanism housing part has a vent passage that communicates the inside and the outside of the motion converting mechanism housing part, and an air filter that is disposed in the vent passage. When the first housing is removed from the body housing, the rotation transmitting mechanism housing part is exposed, and when the second housing is removed from the body housing, the air filter is exposed. The handle is removably connected to at least one of the first housing and the second housing, and when the handle is removed from at least one of the first housing and the second housing, electric components relating to driving of the motor are exposed. Further, the "electric components relating to driving of the motor" here may represent a controller, an electric wire and an electric switch for controlling driving of the motor.

According to a further aspect of the representative impact tool, the body housing has a barrel that houses part of the driving mechanism. The outer housing has a barrel cover that covers the barrel, and a side handle mounting part to which a side handle can be mounted is formed on the barrel cover.

According to this aspect, a user can mount the side handle onto the barrel cover of the outer housing, hold the handle and the side handle and operate the impact tool.

According to a further aspect of the representative impact tool, the impact tool has a guide part that guides the outer housing and the handle with respect to the body housing in the axial direction of the tool accessory. The guide part includes a first sliding part formed in the body housing and a second sliding part formed in the handle.

According to this aspect, with the structure in which the outer housing and the handle that can move with respect to the body housing in the axial direction of the tool accessory are guided by the guide part, stable movement of the outer housing and the handle with respect to the body housing can be realized.

According to a further aspect of the representative impact tool, the impact tool has a weight that moves linearly in the axial direction of the tool accessory during hammering operation in which the tool accessory is driven in the axial direction, so as to reduce vibration caused in the body housing during the hammering operation. The "weight" here may suitably include a weight that is provided as a component of a counter weight or a dynamic vibration reducer which reduces vibration caused in the body housing by linear movement against this vibration during hammering operation.

According to this aspect, vibration which is caused in the body housing in the axial direction of the tool accessory during hammering operation can be reduced by the weight.

According to a further aspect of the representative impact tool, the impact tool has an elastic element, a dynamic vibration reducer and a mechanical vibration mechanism. The dynamic vibration reducer has a weight which is acted upon by a biasing force of the elastic element and can linearly move, and by movement of the weight in the axial direction of the tool accessory, the dynamic vibration reducer reduces vibration caused in the body housing during hammering operation. The mechanical vibration mechanism actively drives the weight by applying an external force other than vibration of the body housing to the weight via the elastic element during hammering operation.

According to this aspect, the weight of the dynamic vibration reducer is actively driven by the mechanical vibration mechanism so that vibration of the impact tool can be effectively reduced.

As described above, an impact tool is provided which has improved in cooling performance for cooling a motor or a driving mechanism part.

REPRESENTATIVE EMBODIMENT

An electric hammer 100 is described as a representative example of an impact tool with reference to FIGS. 1 to 9. An electric hammer 100 according to this embodiment is an impact tool that has a hammer bit 119 (see FIG. 5) coupled to a front end region of a tool body or a body 101 and performs a chipping operation on a workpiece such as concrete by striking movement of the hammer bit 119 in its axial direction. The hammer bit 119 is removably attached to the body 101 via a cylindrical tool holder 131. Further, the hammer bit 119 is inserted into a bit insertion hole of the tool holder 131 and held such that it is prevented from rotating in a circumferential direction with respect to the tool holder 131. The hammer bit 119 is an example embodiment that corresponds to the "tool accessory" according to the invention.

Figure 5:
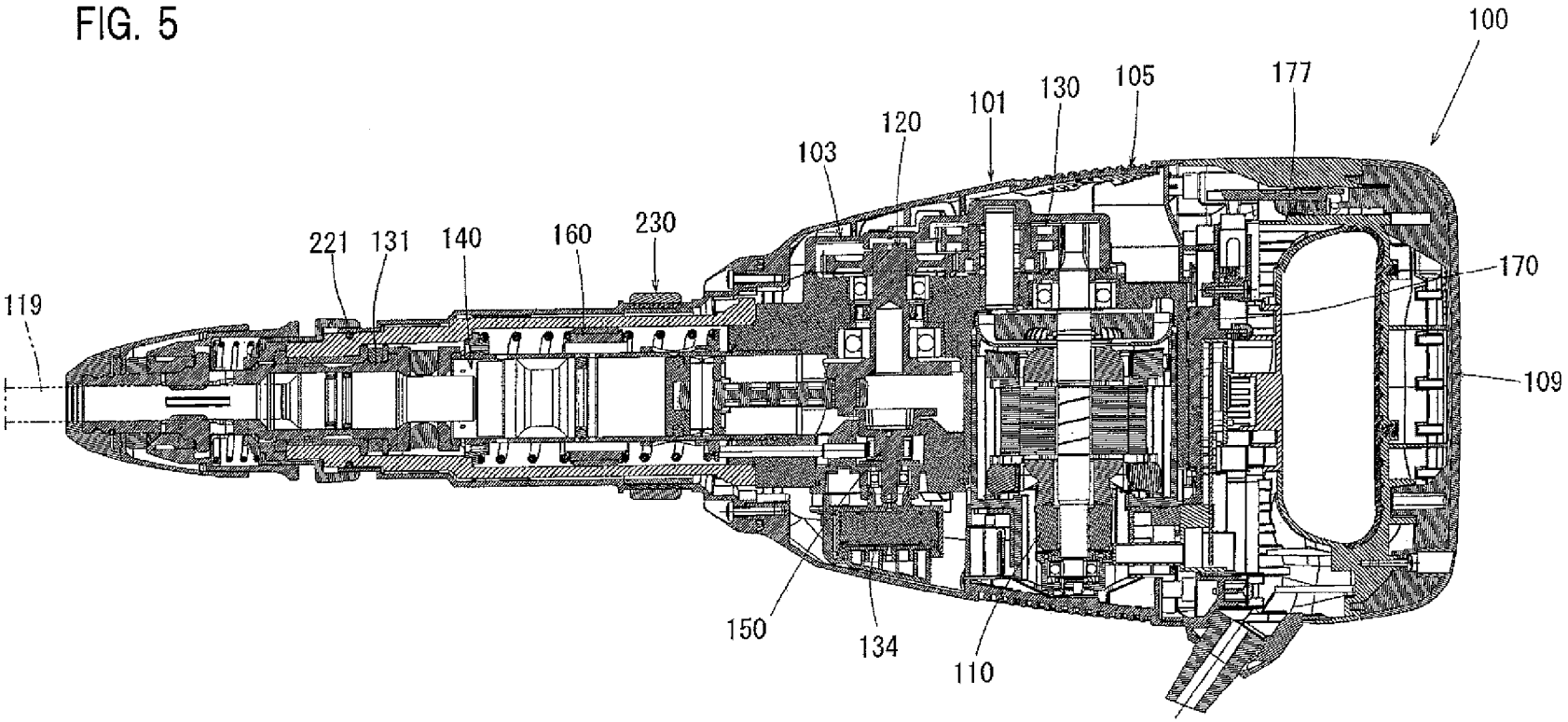
FIG. 5 is a longitudinal sectional view showing an internal structure of the electric hammer.

As shown in FIG. 5, the body 101 mainly includes a body housing 103 that houses an electric motor 110, a first crank mechanism 120, a second crank mechanism 150, a gear reducer 130 and a striking mechanism 140, an outer housing 105 that covers the body housing 103, and a handgrip 109 that is integrally connected to the outer housing 105. The body housing 103, the outer housing 105 and the handgrip 109 are example embodiments that correspond to the "body housing", the "outer housing" and the "handle", respectively, according to the invention.

Figure 4:
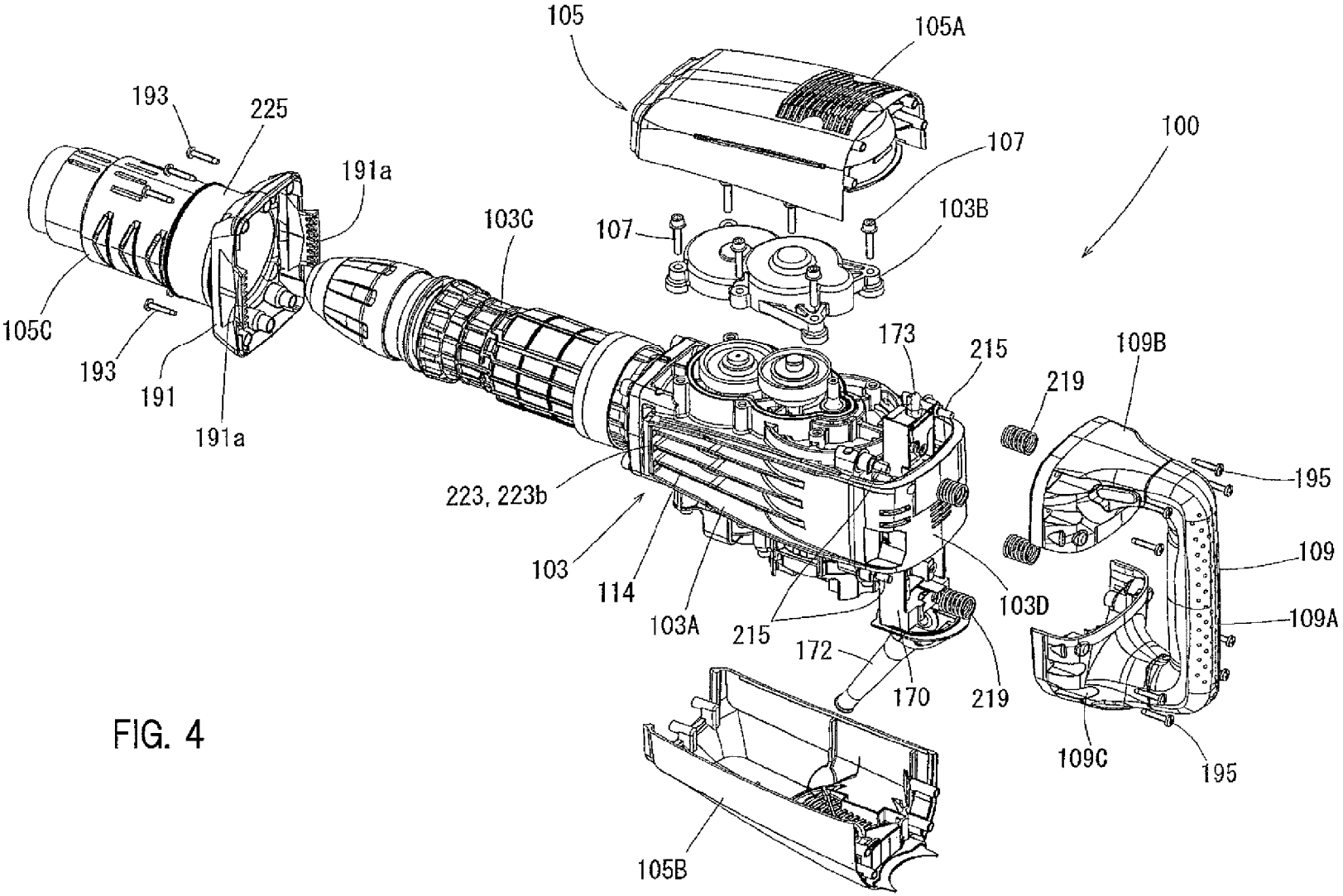
FIG. 4 is a perspective view showing the electric hammer with the outer housing disassembled.

FIG. 4 shows the electric hammer 100 with the outer housing 105 disassembled. The body housing 103 includes a crank housing 103A that houses the electric motor 110, the first crank mechanism 120 and the second crank mechanism 150, a gear housing 103B that houses the gear reducer 130, a barrel 103C that houses the striking mechanism 140, and a rear cover 103D that covers electric components. The crank housing 103A and the gear housing 103B are example embodiments that correspond to the "motion converting mechanism housing part" and the "rotation transmitting mechanism housing part", respectively, according to the invention. Both the crank housing 103A and the barrel 103C are made of aluminum and removably connected to each other by screws (not shown) in the axial direction of the hammer bit 119. The gear housing 103B is made of aluminum and removably connected by screws 107 to one end of the crank housing 103A in a direction crossing the axial direction of the hammer bit 119. The rear cover 103D is made of resin and removably connected by screws (not shown) to the crank housing 103A on the opposite side from the barrel 103C. Further, the crank housing 103A is partitioned into a space for housing the electric motor 110 and a space for housing the first crank mechanism 120 and the second crank mechanism 150.

Figure 1:
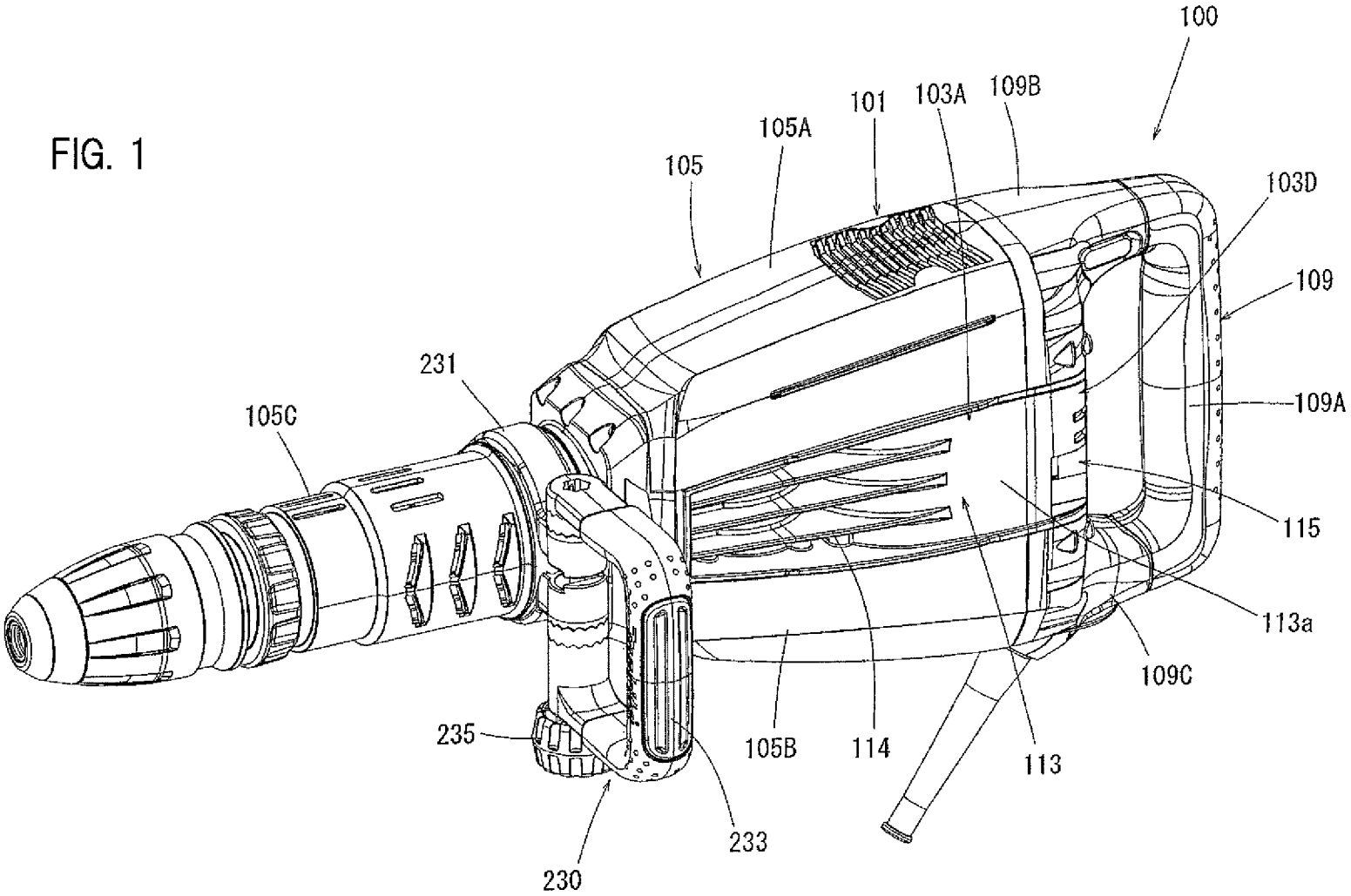
FIG. 1 is a perspective view showing an external appearance of an electric hammer according to an embodiment of the invention.
Figure 2:
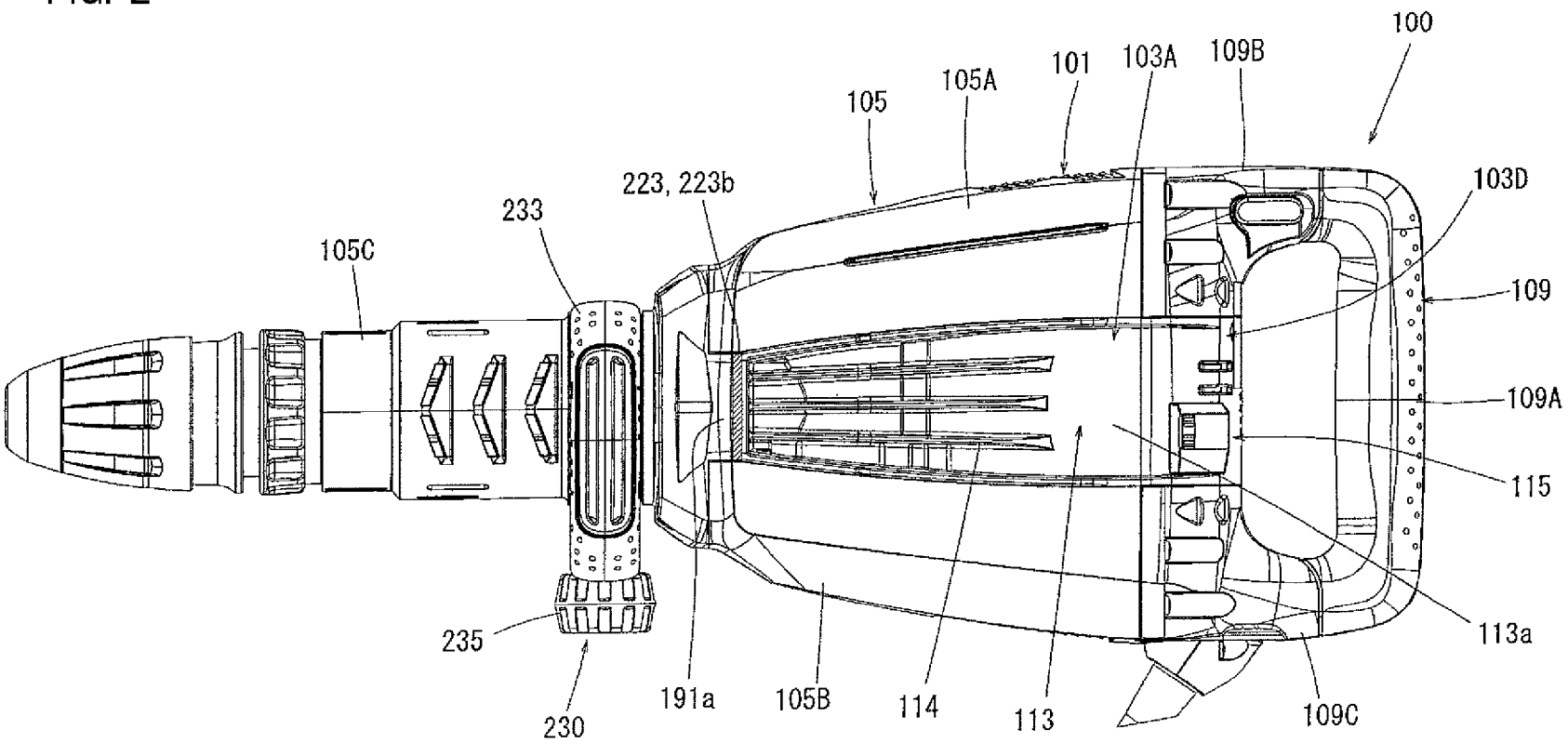
FIG. 2 is a side view of the electric hammer, showing an outer housing and a handgrip in an initial position.
Figure 3:
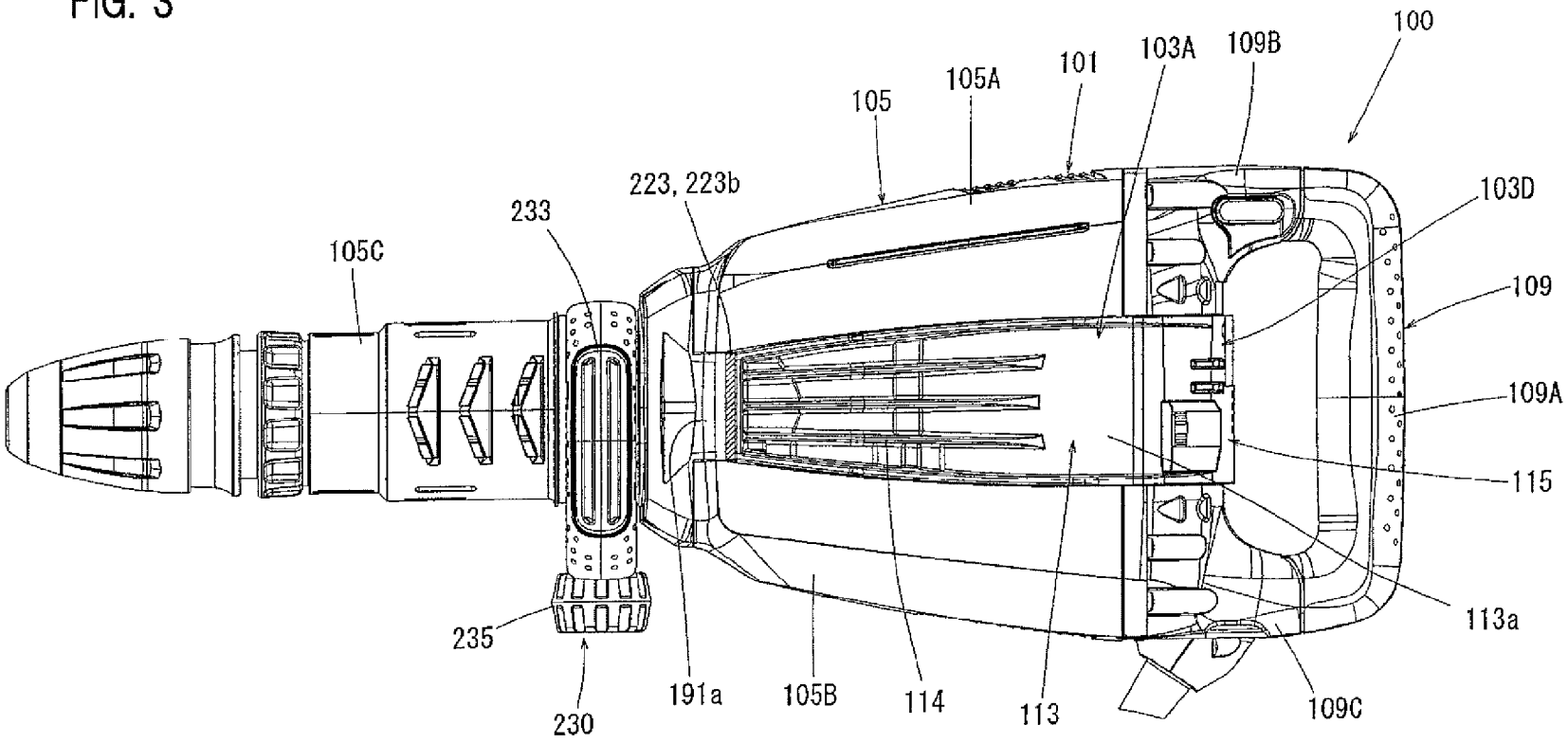
FIG. 3 is a side view of the electric hammer, showing the outer housing and the handgrip moved forward with respect to a body housing.

As shown in FIGS. 1 to 3, the handgrip 109 which is held by a user in a chipping operation is arranged on the opposite side of the outer housing 105 from the hammer bit 119 in the axial direction of the hammer bit 119. In this embodiment, for the sake of convenience of explanation, the hammer bit 119 side in the axial direction of the hammer bit 119 or a longitudinal direction of the body 101 is referred to as a front side and its opposite side is referred to as a rear side. Further, the gear housing 103B side in the direction crossing the axial direction of the hammer bit 119 is referred to as an upper side and its opposite side is referred to as a lower side.

In the electric hammer 100 according to this embodiment, a motor shaft 111 of the electric motor 110 and a grip part 109A of the handgrip 109 are arranged to extend in parallel to each other and in a vertical direction crossing an axis extending in the axial direction of the hammer bit 119. Further, the electric hammer 100 is configured as an in-line type electric hammer in which the electric motor 110 and the handgrip 109 are disposed on the axis of the hammer bit 119. The electric motor 110 is driven by power feeding from an alternating current (AC) power source. The electric motor 110 is an example embodiment that corresponds to the "motor" according to the invention.

Figure 6:
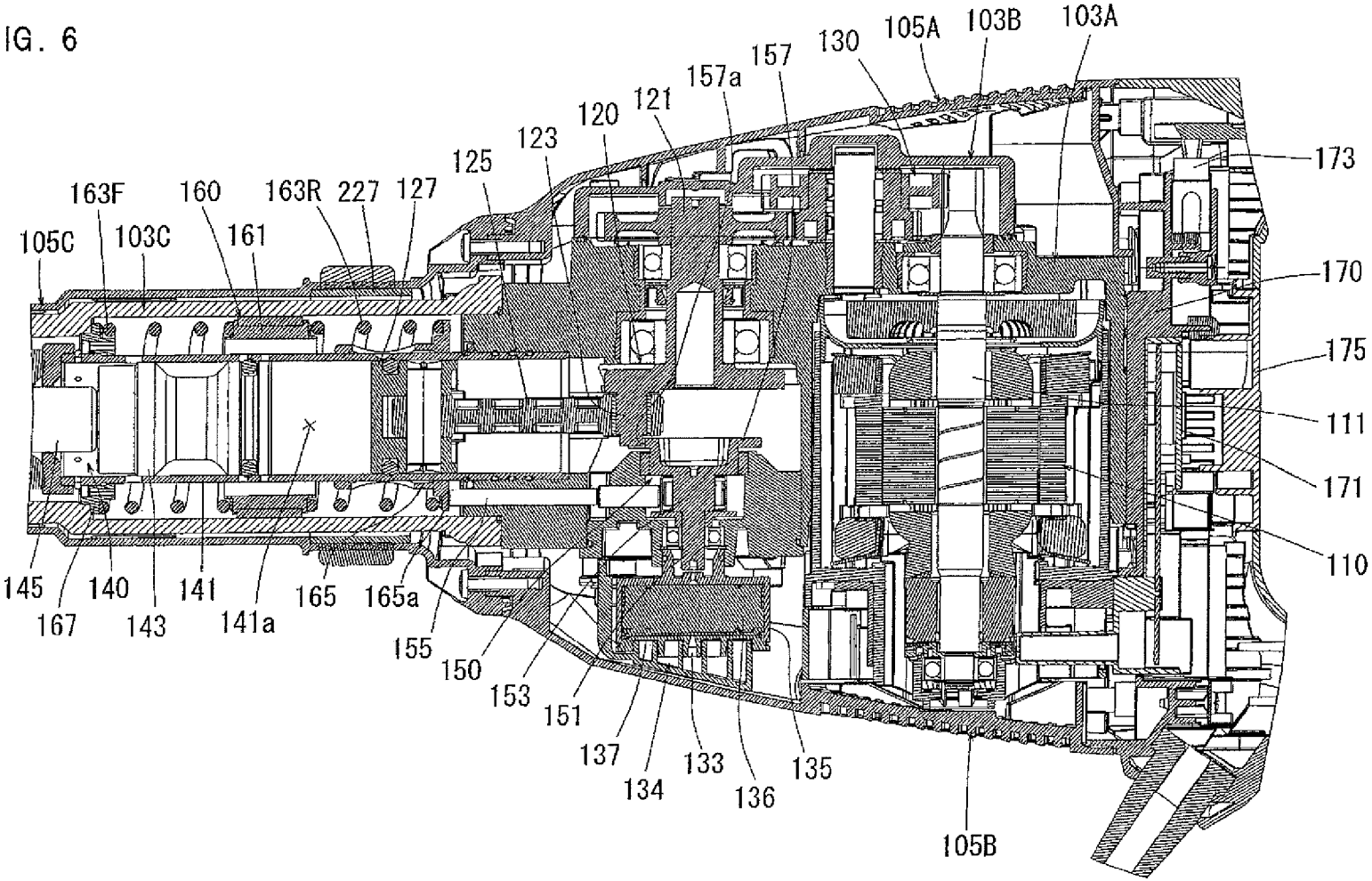
FIG. 6 is a partially enlarged sectional view of FIG. 5.

As shown in FIGS. 5 and 6, rotation of the electric motor 110 is transmitted to the first crank mechanism 120 via the gear reducer 130 and then appropriately converted into linear motion by the first crank mechanism 120. The linear motion is then transmitted to the striking mechanism 140, which causes the striking mechanism 140 to strike the hammer bit 119 in the axial direction (leftward as viewed in FIG. 1). Further, rotation of the electric motor 110 is transmitted to the second crank mechanism 150 via the first crank mechanism 120 and is converted into linear motion by the second crank mechanism 150. The linear motion serves as a driving force for forcibly vibrating a dynamic vibration reducer 160. The gear reducer 130, the first crank mechanism 120 and the striking mechanism 140 are example embodiments that correspond to the "driving mechanism" according to the invention.

The first crank mechanism 120 serves to convert rotation of the electric motor 110 transmitted via the gear reducer 130 into linear motion and to transmit it to the striking mechanism 140, and is disposed in front of the electric motor 110. The first crank mechanism 120 is an example embodiment that corresponds to the "motion converting mechanism" according to the invention. As shown in FIG. 6, the first crank mechanism 120 includes a first crank shaft 121 which is driven by the gear reducer 130, an eccentric pin 123, a connecting rod 125 and a piston 127. The piston 127 forms a driving element for driving the striking mechanism 140 and can slide in the axial direction of the hammer bit 119 within a cylinder 141. Further, the first crank shaft 121 is arranged in parallel to the motor shaft 111 of the electric motor 110.

The gear reducer 130 serves to transmit rotation of the electric motor 110 to the first crank shaft 121 of the first crank mechanism 120, and includes a plurality of gears. Further, the gear reducer 130 is disposed in one axial end region or an upper end region of the first crank shaft 121 and housed in the gear housing 103B.

As shown in FIG. 6, the striking mechanism 140 mainly includes a striking element or a striker 143 that is slidably disposed within the cylinder 141 and linearly moves in the axial direction of the hammer bit 119, and an intermediate element or an impact bolt 145 that is slidably disposed within the tool holder 131 and transmits kinetic energy of the striker 143 to the hammer bit 119. The cylinder 141 is coaxially disposed at the rear of the tool holder 131 and has an air chamber 141*a* partitioned by the piston 127 and the striker 143. The striker 143 is driven via an action of an air spring of the air chamber 141*a* which is caused by the sliding movement of the piston 127 and then collides with the impact bolt 145, which causes the impact bolt 145 to strike the hammer bit 119. As a result, the hammer bit 119 performs a hammering operation on the workpiece.

As shown in FIG. 6, the second crank mechanism 150 serves to convert rotation of the electric motor 110 into linear motion and transmit it to the dynamic vibration reducer 160, and is provided as a mechanism that forcibly vibrates the dynamic vibration reducer 160 by actively driving a weight 161 of the dynamic vibration reducer 160. The second crank mechanism 150 is an example embodiment that corresponds to the "mechanical vibration mechanism" according to the invention. The dynamic vibration reducer 160 is provided as a means for reducing vibration caused in the body housing 103 during hammering operation. In this specification, forcibly vibrating the dynamic vibration reducer 160 is hereinafter referred to as forced vibration. The dynamic vibration reducer 160 mainly includes a cylindrical weight 161 that is arranged in an annular shape to cover the whole outer circumferential surface of the cylinder 141 in an internal space of the barrel 103C, and front and rear biasing springs 163F, 163R that are disposed on the front and rear sides of the weight 161 in the axial direction of the hammer bit 119. The weight 161 and the biasing springs 163F, 163R are example embodiments that correspond to the "weight" and the "elastic element", respectively, according to the invention. The front and rear biasing springs 163F, 163R apply spring forces to the weight 161 toward each other when the weight 161 moves in the axial direction of the hammer bit 119.

The weight 161 can slide with its outer circumferential surface held in contact with an inner wall surface (cylindrical surface) of the barrel 103C. Further, each of the front and rear biasing springs 163F, 163R comprises a compression coil spring. One end of the rear biasing spring 163R is held in contact with a front surface of a flange 165*a* of a slide sleeve 165 that serves as a spring receiving member, and the other end is held in contact with an axial rear end of the weight 161. Further, one end of the front biasing spring 163F is held in contact with an axial front end of the weight 161 and the other end is held in contact with a stepped surface of the barrel 103C via a ring-like member 167 that serves as the spring receiving member.

The slide sleeve 165 forms an input member that inputs a driving force of the second crank mechanism 150 into the weight 161 via the rear biasing spring 163R. The slide sleeve 165 is fitted onto the cylinder 141 such that it can slide in the axial direction of the hammer bit, and is slid by the second crank mechanism 150.

The second crank mechanism 150 is disposed on the other axial end or lower side of the first crank shaft 121 of the first crank mechanism 120. As shown in FIG. 6, the second crank mechanism 150 mainly includes a second crank shaft 151 that is rotated by rotation of the eccentric pin 123 of the first crank mechanism 120, an eccentric shaft 153 that is integrally formed on the second crank shaft 151, and a rod 155 serving as an operating member that is linearly moved in the axial direction of the hammer bit 119 by rotation of the eccentric shaft 153 and moves the slide sleeve 165 forward.

The second crank shaft 151 is arranged coaxially and opposedly to the first crank shaft 121 and has a disc 157 on the side facing the first crank shaft 121. The disc 157 has a recess 157*a* in a position displaced from the center of rotation of the second crank shaft 151, and a protruding end of the eccentric pin 123 of the first crank mechanism 120 is engaged with the recess 157*a*. Specifically, the second crank shaft 151 is rotated by driving force which is inputted from the first crank shaft 121 through engagement between the disc 157 and the eccentric pin 123.

During hammering operation, when the first crank shaft 121 is rotated, the second crank shaft 151 which is engaged with the eccentric pin 123 via the disc 157 is rotated at the same speed as the first crank shaft 121. The rod 155 which is held in contact with an outer circumferential surface of the eccentric shaft 153 is linearly moved by rotation of the eccentric shaft 153 of the second crank shaft 151. When the rod 155 moves forward, the slide sleeve 165 is pushed forward by the rod 155 and compresses the biasing springs 163F, 163R. On the other hand, when the rod 155 moves rearward, the slide sleeve 165 is pushed rearward by spring forces of the biasing springs 163F, 163R. Specifically, during hammering operation, the weight 161 of the dynamic vibration reducer 160 is actively driven by the second crank mechanism 150 via the biasing springs 163F, 163R. As a result, the dynamic vibration reducer 160 is forcibly vibrated, so that vibration caused in the body housing 103 can be effectively reduced.

As shown in FIG. 6, a filter unit 134 is disposed in a lower region of the crank housing 103A on the side opposite from the gear reducer 130 or a region of the crank housing 103A in which the second crank mechanism 150 is housed. The filter unit 134 has a pressure control passage 133 for discharging air from the crank chamber to the outside of the crank housing 103A. The filter unit 134 is an example embodiment that corresponds to the "filter unit" according to the invention. The filter unit 134 is provided as a structure for discharging air from the crank chamber to the outside of the crank housing 103A through the pressure control passage 133 when air in the crank chamber is expanded and increased in pressure by heat which is generated by driving of the first crank mechanism 120 and the striking mechanism 140.

The filter unit 134 mainly includes a filter housing case 135 that is fixedly mounted to the outside of the crank housing 103A, a filter 136 that is removably housed in the filter housing case 135, and a case cover 137 that is removably mounted to the filter housing case 135 and holds the filter 136. The filter 136 is provided as a lubricant adsorbent that serves to prevent lubricant (grease) filled into the crank chamber from leaking to the outside together with air. The case cover 137 can be removed from the filter housing case 135 for maintenance check and replacement of the filter 136.

As shown in FIGS. 4 and 6, an electric component housing case 170 is disposed on a rear of the crank housing 103A on the side opposite from the hammer bit 119 and houses electric components such as a controller 171 and an electric switch 173 for controlling driving of the electric motor 110. The controller 171 and the electric switch 173 are example embodiments that correspond to the "electric components" according to the invention. A current supply cable 172 for external power supply is connected to the controller 171. A rear cover 103D is disposed at the rear of the crank housing 103A and removably mounted to the crank housing 103A. The rear cover 103D has a generally U-shape as viewed from top and covers the sides and the back of a middle region of the electric component housing case 170 in its vertical direction. Therefore, the rear cover 103D can be removed from the crank housing 103A for maintenance check of the controller 171. Further, a switch operation member 177 is provided on the handgrip 109 and can be slid by the user in a transverse direction crossing the axial direction of the hammer bit 119. The electric switch 173 can be switched between an on state and an off state by sliding the switch operation member 177. When the electric switch 173 is turned on, the electric motor 110 is driven and when the electric switch 173 is turned off, the electric motor 110 is stopped.

Figure 9:
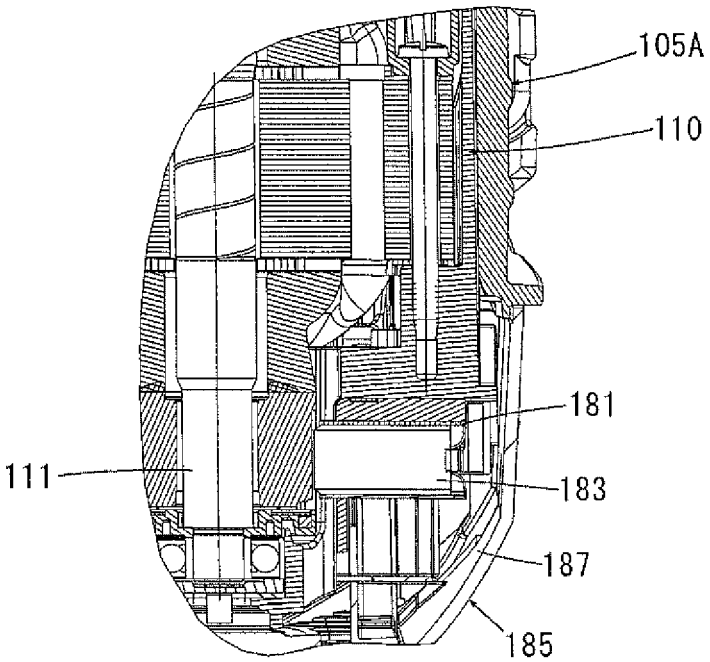
FIG. 9 is a partial view showing an arrangement of a carbon brush holder of an electric motor.

As shown in FIG. 9, a cylindrical carbon brush holder 181 is housed in a region of the crank housing 103A which corresponds to one axial end (lower end) region of the motor shaft 111 of the electric motor 110. A carbon brush 183 for supplying a current to a commutator of the electric motor 110 is housed in the carbon brush holder 181. An opening 187 is formed in a brush holder housing region 185 which houses the carbon brush holder 181, so that maintenance check and replacement of the carbon brush 183 can be performed through the opening 187 from the outside of the crank housing 103A.

As shown in FIG. 4, the outer housing 105 disposed on the outside of the body housing 103 mainly includes an upper housing cover 105A, a lower housing cover 105B and a barrel cover 105C. The upper housing cover 105A has a U-shaped section having an open lower end and covers a whole upper surface of the crank housing 103A of the body housing 103, including the gear housing 103B, and upper regions of right and left sides thereof. The lower housing cover 105B has a U-shaped section having an open upper end and covers a whole lower surface of the crank housing 103A of the body housing 103, including the filter unit 134 and the brush holder housing region 185, and lower regions of right and left sides thereof. Further, the upper housing cover 105A, the lower housing cover 105B and the barrel cover 105C are made of synthetic resin.

In this embodiment, as shown in FIGS. 1 to 3, when the upper housing cover 105A and the lower housing cover 105B are mounted on the outside of the crank housing 103A, a lower end of the side surface of the upper housing cover 105A and an upper end of the side surface of the lower housing cover 105B are opposed to each other with a prescribed spacing in the vertical direction. Therefore, an opening is formed between the lower end of the side surface of the upper housing cover 105A and the upper end of the side surface of the lower housing cover 105B, so that right and left side surfaces of a region of the crank housing 103A which houses the electric motor 110, the first crank mechanism 120 and the second crank mechanism 150 are exposed to the outside through the opening.

Specifically, an exposed region 113 which is not covered by the upper housing cover 105A and the lower housing cover 105B is formed in the right and left side surfaces of the region of the crank housing 103A which houses the electric motor 110, the first crank mechanism 120 and the second crank mechanism 150. The exposed region 113 is an example embodiment that corresponds to the "exposed region" according to the invention. The exposed region 113 extends in the axial direction of the hammer bit 119. An outer surface of a rear region 113*a* of the exposed region 113 which is adjacent to the handgrip 109 is formed flush with outer surfaces of the upper housing cover 105A and the lower housing cover 105B. The outer surface of the rear region 113*a* is an example embodiment that corresponds to the "outer surface region" according to the invention. Further, a front region of the exposed region 113 which extends forward of the rear region 113*a* is a recessed part recessed inward, and a plurality of plate-like heat dissipation fins 114 extending in the axial direction of the hammer bit 119 are formed in the recessed part at prescribed intervals in the vertical direction. The heat dissipation fins 114 protrude outward from a bottom surface of the recessed part, and protruding end surfaces of the heat dissipation fins 114 are formed flush with the outer surface of the rear region 113*a*.

The barrel cover 105C is shaped in a cylindrical form and configured to cover the whole region of the barrel 103C of the body housing 103 other than a front end thereof. A square cylindrical part 191 is formed on a rear end of the barrel cover 105C. The upper and lower housing covers 105A, 105B are removably connected to the barrel cover 105C by a plurality of screws 193 (see FIG. 4) with front ends of the upper housing cover 105A and the lower housing cover 105B held in contact with a rear end of the cylindrical part 191.

The handgrip 109 made of synthetic resin is disposed on the rear side of the outer housing 105. As shown in FIGS. 1 to 5, the handgrip 109 mainly includes a grip part 109A that extends in the vertical direction crossing the axial direction of the hammer bit 119, an upper connecting region 109B that is formed on one end of the grip part 109A in its extending direction and a lower connecting region 109C that is formed on the other end of the grip part 109A in its extending direction. The upper connecting region 109B and the lower connecting region 109C are opposed to each other with a prescribed spacing in the extending direction of the grip part 109A and extend forward or toward the upper and lower housing covers 105A, 105B. The upper connecting region 109B has a U-shaped section having an open lower end, and a U-shape of a front end of the upper connecting region 109B corresponds to a U-shape of a rear end of the upper housing cover 105A. Further, the lower connecting region 109C has a U-shaped section having an open upper end, and a U-shape of a front end of the lower connecting region 109C corresponds to a U-shape of a rear end of the lower housing cover 105B.

The handgrip 109 is arranged with the front end of the upper connecting region 109B in contact with the rear end of the upper housing cover 105A and with the front end of the lower connecting region 109C in contact with the rear end of the lower housing cover 105B. In this state, the handgrip 109 is removably connected to the upper and lower housing covers 105A, 105B by screws 195 (see FIG. 4). Specifically, the upper housing cover 105A and the lower housing cover 105B are connected to each other at their rear ends via the handgrip 109 and also connected to each other at their front ends via the barrel cover 105C. Further, an opening through which the current supply cable 172 is inserted is formed in a butting part between the lower connecting region 109C and the lower housing cover 105B.

When the handgrip 109 is arranged as described above, a region which is covered by the upper connecting region 109B and the lower connecting region 109C and a region which is not covered thereby are formed on the rear side of the crank housing 103A. Specifically, an exposed region 115 which is not covered by the upper connecting region 109B and the lower connecting region 109C is formed in between the upper connecting region 109B and the lower connecting region 109C in the vertical direction, and the rear cover 103D of the body housing 103 is configured to be disposed over the exposed region 115. In other words, the rear cover 103D has a shape corresponding to the shape of the exposed region 115. Further, an outer surface of the rear cover 103D corresponding to the exposed region 115 is formed flush with the outer surfaces of the upper connecting region 109B, the lower connecting region 109C and the exposed region 113 of the crank housing 103A.

The outer housing 105 and the handgrip 109 which are integrally connected to each other by screws 195 as described above are connected to the body housing 103 so as to be allowed to move in the axial direction of the hammer bit 119 with respect to the body housing 103 via a slide guide 211 and a compression coil spring 219. By provision of such a structure, a vibration-proofing housing with a handle is provided.

Figure 7:
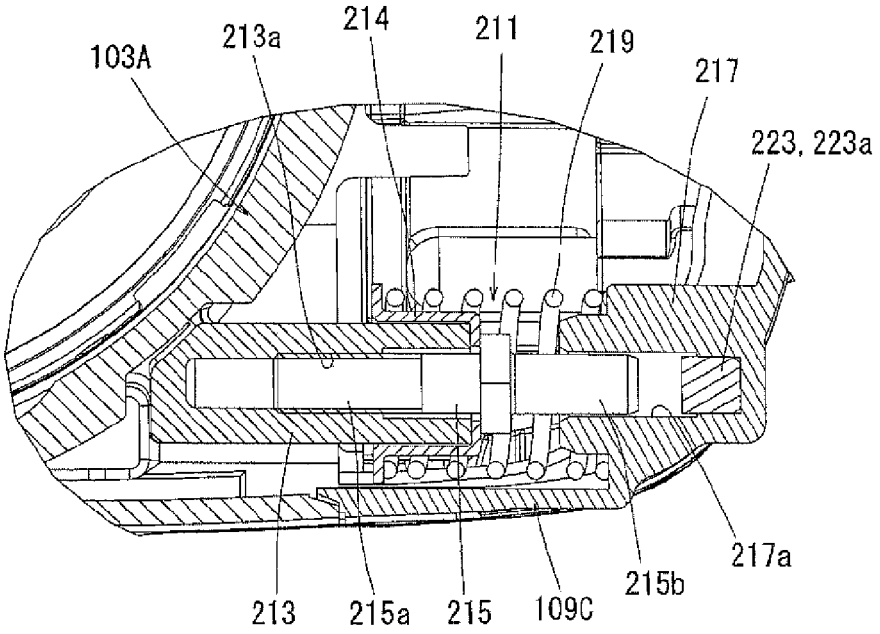
FIG. 7 is a sectional view showing a slide guide for guiding the handgrip, in the initial position of the handgrip.
Figure 8:
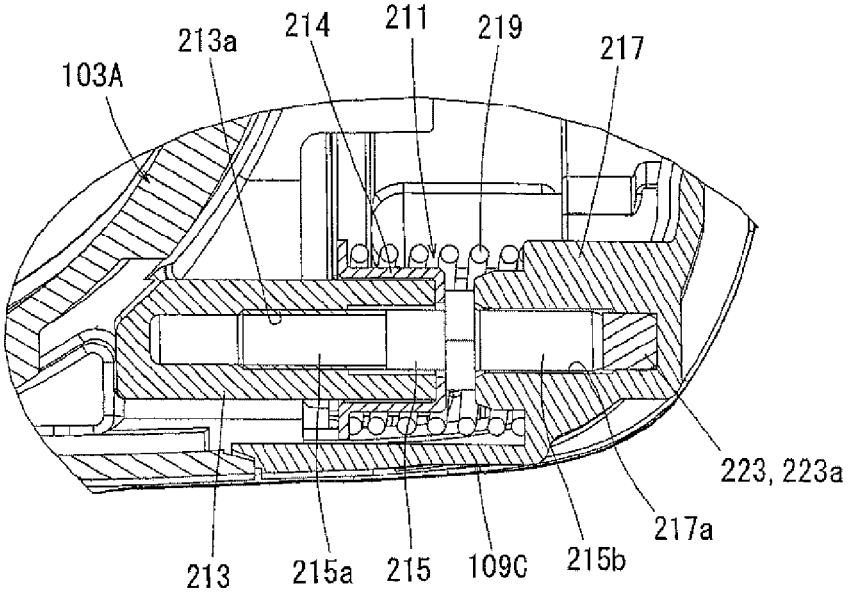
FIG. 8 is a sectional view showing the slide guide for guiding the handgrip, in the state in which the handgrip is moved forward.

As shown in FIGS. 7 and 8, the slide guide 211 mainly includes a guide shaft 215 and a slide cylinder 217. The slide guide 211 is an example embodiment that corresponds to the "guide part" according to the invention. The crank housing 103A of the body housing 103 has the guide shaft 215 that has a circular section and serves to guide the handgrip 109 in the axial direction of the hammer bit 119. Four cylindrical shaft holding parts 213 each having a threaded hole are formed on the left, right, top and bottom on the rear end of the crank housing 103A. The guide shaft 215 is made of iron and has a male screw 215*a* on its one axial end. The male screw 215*a* is threadably engaged with the screw hole 213*a* of each of the shaft holding parts 213, so that the guide shaft 215 is mounted to the shaft holding part 213 and extends in parallel to the axial direction of the hammer bit 119. The guide shaft 215 has a protruding portion 215*b* that integrally protrudes rearward from a rear end of the shaft holding part 213 by a prescribed length.

The slide cylinder 217 is provided to correspond to the guide shaft 215 in each of the upper and lower connecting regions 109B, 109C of the handgrip 109 and an outer circumferential surface of the protruding portion 215*b* of the guide shaft 215 is slidably fitted into an inner circumferential surface of a bore 217*a* of the slide cylinder 217. In this manner, the handgrip 109 and the outer housing 105 are mounted to the crank housing 103A so as to be allowed to move with respect to the crank housing 103A in the axial direction of the hammer bit 119. The inner circumferential surface of the bore 217*a* and the outer circumferential surface of the protruding portion 215*b* are example embodiments that correspond to the "first sliding part" and the "second sliding part", respectively, according to the invention. The compression coil spring 219 is arranged to surround the outside of the guide shaft 215. The compression coil spring 219 is provided as a member that elastically connects the handgrip 109 and the crank housing 103A. One axial end of the compression coil spring 219 is supported by the shaft holding part 213 via a spring receiver 214 and the other axial end is supported by the slide cylinder 217. The compression coil spring 219 is an example embodiment that corresponds to the "elastic element" according to the invention.

As shown in FIG. 5, an elastic ring 221 is elastically disposed between an inner circumferential surface of the barrel cover 105C of the outer housing 105 and an outer circumferential surface of the barrel 103C. The elastic ring 221 is made of rubber and serves to position the barrel cover 105C with respect to the barrel 103C in a radial direction (a direction crossing the axial direction of the hammer bit 119) and also serves as a vibration-proofing member by elastically deforming in the axial direction and the radial direction.

The electric hammer 100 further has a stopper 223 which defines a moving range of the outer housing 105 with respect to the body housing 103. The stopper 223 includes a pair of front and rear stopper members 223*a*, 223*b*. The front and rear stopper members 223*a*, 223*b* are made of elastomer.

As shown in FIGS. 2 to 4, the front stopper members 223*b* are disposed in front end regions of the exposed regions 113 of the right and left sides of the body housing 103. Right and left plate-like projections 191*a* protruding rearward are provided on the rear end of the cylindrical part 191 of the barrel cover 105C so as to correspond to the front stopper members 223*b*. When the barrel cover 105C moves rearward, the projections 191*a* come in contact with the front stopper members 223*b* and define a rear end position of the outer housing 105. This contact state is shown in FIG. 2.

As shown in FIGS. 7 and 8, each of the rear stopper members 223*a* is disposed in the bottom of the bore 217*a* of the slide cylinder 217. When the handgrip 109 moves forward, the rear stopper member 223*a* comes in contact with a rear end of the protruding portion 215*b* of the guide shaft 215 and defines a front end position of the outer housing 105 integrally formed with the handgrip 109. This contact state is shown in FIG. 8.

In FIGS. 7 and 8, for the sake of explanation, the front stopper member 223*b* is distinguished from the outer housing 105 and the body housing 103 by showing it in hatched lines inclined downward to the left.

The compression coil spring 219 is imparted with a prescribed load before assembled. Thus, a rearward biasing force is normally applied to the handgrip 109 and the outer housing 105. Therefore, the handgrip 109 and the outer housing 105 are held in a position in which the front stopper members 223*b* are held in contact with the projections 191*a* of the cylindrical part 191. This position is an initial position of the handgrip 109 and the outer housing 105.

As shown in FIGS. 1 to 4, the barrel cover 105C has a cylindrical side grip mounting part 225 on which an auxiliary handle or a side grip 230 can be mounted. The side grip mounting part 225 is an annular part having a circular section. The side grip mounting part 225 and the side grip 230 are example embodiments that correspond to the "side handle mounting part" and the "side handle", respectively, according to the invention.

As shown in FIG. 1, the side grip 230 mainly includes a mounting ring 231 that is removably mounted on the side grip mounting part 225, a grip part 233 that is connected to the mounting ring 231, and an operating member 235 that can be turned by a user to widen or narrow the diameter of the mounting ring 231. The side grip 230 is secured to the side grip mounting part 225 by turning the operating member 235 such that the mounting ring 231 clamps an outer circumferential surface of the side grip mounting part 225 from the outside. Further, the position of the grip part 233 can be changed in a circumferential direction of the side grip 230 by turning the operating member 235 such that the mounting ring 231 is released or loosened.

As shown in FIGS. 4 and 6, an iron sleeve 227 is disposed in a region of an inner circumferential surface of the barrel cover 105C at a position corresponding to the side grip mounting part 225. The sleeve 227 is provided as a reinforcing member for increasing the strength of the side grip mounting part 225 and serves to prevent deformation of the side grip mounting part 225 which may be caused when the mounting ring 231 is tightened.

The electric hammer 100 according to this embodiment is configured as described above. Therefore, in order to drive the electric motor 110 and perform a chipping operation on a workpiece by linearly moving the hammer bit 119, the user holds both the handgrip 109 and the side grip 230 and slides the switch operation member 177 to turn on the electric switch 173 while pressing the front end of the hammer bit 119 against the workpiece.

In above-described chipping operation, impulsive and cyclic vibration is caused mainly in the axial direction of the hammer bit 119 in the body housing 103 of the electric hammer 100. In this embodiment, the handgrip 109 is integrally connected to the outer housing 105 and elastically connected to the body housing 103 via the compression coil spring 219. Further, the barrel cover 105C of the outer housing 105 is connected to the barrel 103C of the body housing 103 via the elastic ring 221, and the side grip 230 is mounted on the barrel cover 105C. With such a structure, when the above-described vibration is caused in the body housing 103, the compression coil spring 219 and the elastic ring 221 elastically deform, which causes the outer housing 105, the handgrip 109 and the side grip 230 to move with respect to the body housing 103 in the axial direction of the hammer bit 119. As a result, transmission of vibration from the body housing 103 to the outer housing 105, the handgrip 109 and the side grip 230 is reduced.

According to this embodiment, by provision of the structure for guiding the handgrip 109, in which the four guide shafts 215 extending in parallel to the axial direction of the hammer bit 119 are provided on the body housing 103 and the slide cylinders 217 are formed on the handgrip 109 so as to slide on the guide shafts 215, stable and smooth movement of the handgrip 109 and the outer housing 105 with respect to the body housing 103 can be realized.

According to this embodiment, with the structure in which the four compression coil springs 219 are each provided on each of the guide shafts 215, biasing forces of the four compression coil springs 219 can be exerted on the handgrip 109 in a balanced manner.

The electric hammer 100 of this embodiment has the dynamic vibration reducer 160. The weight 161 of the dynamic vibration reducer 160 is actively driven by the second crank mechanism 150 via the biasing spring 163F during hammering operation such that the dynamic vibration reducer 160 is mechanically and forcibly vibrated. By provision of such a structure, the dynamic vibration reducer 160 serves as an active vibration reducing mechanism which actively drives the weight 161 and can effectively reduce vibration which is caused in the body housing 103 in the axial direction of the hammer bit 119 during hammering operation.

According to this embodiment, in the electric hammer 100 in which the body housing 103 is covered by the outer housing 105 to which the handgrip 109 is integrally connected, part of the region of the body housing 103 which houses the electric motor 110, the first crank mechanism 120 and the second crank mechanism 150 is exposed to the outside. Specifically, as shown in FIGS. 1 to 3, the exposed region 113 exposed to the outside of the outer housing 105 is provided in the middle region of each of the right and left sides of the crank housing 103A of the body housing 103 in the vertical direction. By provision of this structure, heat which is generated when the electric motor 110, the first crank mechanism 120, the second crank mechanism 150 and the striking mechanism 140 are driven during hammering operation is easily dissipated to the outside through the exposed regions 113, 115, so that the cooling performance of the electric hammer 100 can be improved. Further, with the structure in which the heat dissipation fins 114 are provided in the exposed region 113, the heat dissipation area is increased, so that the heat exchange efficiency in the exposed region 113 can be improved.

According to this embodiment, the exposed region 113 of the body housing 103 is configured to be flush with the outer surfaces of the side surface regions of the upper housing cover 105A and the lower housing cover 105B of the outer housing 105. By provision of this structure, the side surface of the outer housing 105 including the exposed region 113 of the body housing 103 has a large outer surface, so that an excellent appearance can be obtained.

According to this embodiment, the upper housing cover 105A and the lower housing cover 105B of the outer housing 105 can be disconnected from the barrel cover 105C and the handgrip 109 so as to be removed from the body housing 103. When the upper housing cover 105A is removed, the gear housing 103B that houses the gear reducer 130 is exposed, and when the lower housing cover 105B is removed, the filter unit 134 and a region of the crank housing 103A that houses the carbon brush holder 181 are exposed. Therefore, maintenance check of the gear reducer 130, the filter unit 134 and the carbon brush 183 can be performed by removing the upper housing cover 105A and the lower housing cover 105B.

According to this embodiment, the handgrip 109 can be disconnected from the upper housing cover 105A and the lower housing cover 105B of the outer housing 105 so as to be removed from the body housing 103. When the handgrip 109 is removed, part of the electric components such as the controller 171, an electric wire and the electric switch 173 which relate to driving of the electric motor 110, is exposed. Therefore, maintenance check of the electric components can be performed by removing the handgrip 109 and the rear housing 103D from the body housing 103.

According to this embodiment, the side grip mounting part 225 to which the side grip 230 can be mounted is formed on the barrel cover 105C of the outer housing 105. Therefore, the user can mount the side grip 230 onto the barrel cover 105C, hold the handgrip 109 and the side grip 230 and operate the electric hammer 100.

In this embodiment, the exposed region is provided in each of the regions of the right and left side surfaces of the crank housing 103A corresponding to the electric motor 110, the first crank mechanism 120 and the second crank mechanism 150, but the invention is not limited to this. The exposed region may be provided such that at least part of the region of the crank housing 103A corresponding to at least one of the electric motor 110 and the first crank mechanism 120 is exposed. For example, a part or the whole of a region of the body housing 103 corresponding to the electric motor 110 may be provided to be exposed, or a part or the whole of a region of the body housing 103 corresponding to the first crank mechanism 120 may be provided to be exposed, or a part or the whole of a region of the body housing 103 corresponding to the electric motor 110 and the first crank mechanism 120 may be provided to be exposed. Further, the exposed region may also be provided on the barrel 103C. Specifically, a window of a prescribed size may be provided in the barrel cover 105C such that the barrel 103C is exposed through the window.

In this embodiment, the upper housing cover 105A and the lower housing cover 105B which are components of the outer housing 105 are connected to each other via the barrel cover 105C and the handgrip 109. However, the upper housing cover 105A and the lower housing cover 105B may be configured to be directly connected to each other. Further, either one of the upper housing cover 105A and the lower housing cover 105B may be configured to be removably connected to the body housing 103. The handgrip 109 may be configured to be connected to either one of the upper housing cover 105A and the lower housing cover 105B.

In this embodiment, the dynamic vibration reducer 160 is provided as a vibration reducing mechanism for reducing vibration of the body housing 103. In order to reduce vibration caused in the body housing 103, however, in place of the dynamic vibration reducer 160, a counter weight may be provided to be linearly moved by the second crank mechanism 150 in the axial direction of the hammer bit 119 against the vibration.

In the above-described embodiment, the electric hammer is explained as a representative example of the impact tool, but a hammer drill may also be an example of the impact tool, which causes the hammer bit 119 to perform linear movement in the axial direction of the hammer bit 119 and rotation around its axis.

Further, following features may be provided in association with any claimed invention.

(Aspect 1)

"An impact tool wherein the body housing has a covering member that covers electric components relating to driving of the motor, and the covering member is exposed to an outer surface of the outer housing."

According to aspect 1, with the structure in which the covering member for covering the electric components is exposed to the outer surface of the outer housing, heat generated in the electric components is easily dissipated to the outside through the covering member.

(Aspect 2)

"An impact tool wherein the handle is removably connected to the first housing and the second housing."

According to aspect 2, not only the first housing and the second housing but also the handle can be removed from the body housing.

(Aspect 3)

"An impact tool wherein the side handle mounting part comprises an annular part having a circular section and a reinforcing sleeve made of iron is fitted into an inner circumferential surface of the annular part."

According to aspect 3, the side handle mounting part can be reinforced by the reinforcing sleeve.

(Aspect 4)

"An impact tool, wherein the guide part has a plurality of guide members that are provided in the body housing and extend in the axial direction of the tool accessory, and a plurality of slide cylinders that are provided in the handle and slidably fitted onto the guide members, and wherein an outer surface of each of the guide members forms the first sliding part and an inner surface of each of the slide cylinders forms the second sliding part."

According to aspect 4, with the structure in which the outer housing and the handle are guided by a plurality of the guide members, the outer housing and the handle can be smoothly moved in the axial direction of the tool accessory with stability.

(Aspect 5)

"An impact tool, wherein:

the body housing has a barrel that houses part of the driving mechanism, the outer housing has a barrel cover that covers the barrel, the impact tool has a stopper that defines a moving range of the outer housing with respect to the body housing, the stopper has a first stopper member that positions the outer housing at a prescribed position when the outer housing moves toward the tool accessory, and a second stopper member that positions the outer housing at a prescribed position when the outer housing moves away from the tool accessory, the first stopper member is disposed between the handle and the body housing in the axial direction of the tool accessory, and the second stopper member is disposed between the barrel cover and the body housing in the axial direction of the tool accessory."

According to aspect 5, the stopper that defines the range of movement of the outer housing with respect to the body housing can be rationally disposed.

(Correspondences Between the Features of the Embodiments and the Representative Impact Tool)

Correspondences between the features of the embodiment and the features of the invention are as follows. Naturally, each feature of the embodiment is only an example for embodiment relating to the corresponding matters to specify the invention, and each feature of the invention is not limited to this.

The electric hammer 100 is an example embodiment that corresponds to the "impact tool" according to the invention.

The hammer bit 119 is an example embodiment that corresponds to the "tool accessory" according to the invention.

The electric motor 110 is an example embodiment that corresponds to the "motor" according to the invention.

The first crank mechanism 120 and the striking mechanism 140 are example embodiments that correspond to the "driving mechanism" according to the invention.

The body housing 103 is an example embodiment that corresponds to the "body housing".

The outer housing 105 is an example embodiment that corresponds to the "outer housing".

The upper housing cover 105A is an example embodiment that corresponds to the "first housing".

The lower housing cover 105B is an example embodiment that corresponds to the "second housing".

The compression coil spring 219 is an example embodiment that corresponds to the "elastic element".

The exposed region 113 is an example embodiment that corresponds to the "exposed region".

The handgrip 109 is an example embodiment that corresponds to the "handle".

The first crank mechanism 120 is an example embodiment that corresponds to the "motion converting mechanism".

The gear reducer 130 is an example embodiment that corresponds to the "rotation transmitting mechanism".

The crank housing 103A is an example embodiment that corresponds to the "motion converting mechanism housing part".

The gear housing 103B is an example embodiment that corresponds to the "rotation transmitting mechanism housing part".

The air filter 131 is an example embodiment that corresponds to the "air filter".

The barrel 103C is an example embodiment that corresponds to the "barrel".

The barrel cover 105C is an example embodiment that corresponds to the "barrel cover".

The side grip 230 is an example embodiment that corresponds to the "side handle".

The side grip mounting part 225 is an example embodiment that corresponds to the "side handle mounting part".

The slide guide 211 is an example embodiment that corresponds to the "guide part".

The second crank mechanism 150 is an example embodiment that corresponds to the "mechanical vibration mechanism".

The dynamic vibration reducer 160 is an example embodiment that corresponds to the "dynamic vibration reducer".

The weight 161 is an example embodiment that corresponds to the "weight".

The biasing springs 163F, 163R are example embodiments that correspond to the "elastic element".

DESCRIPTION OF THE NUMERALS

100 electric hammer (impact tool)
101 body
103 body housing
103A crank housing (motion converting mechanism housing part)
103B gear housing (rotation transmitting mechanism housing part)
103C barrel
103D rear cover
105 outer housing
105A upper housing cover (first housing)
105B lower housing cover (second housing)
105C barrel cover
107 screw
109 handgrip (handle)
109A grip part
109B upper connecting region
109C lower connecting region
110 electric motor (motor)
111 motor shaft
113 exposed region
114 heat dissipation fin
115 exposed region
119 hammer bit (tool accessory)
120 first crank mechanism (motion converting mechanism, driving mechanism)
121 first crank shaft
123 eccentric pin
125 connecting rod
127 piston
130 gear reducer (rotation transmitting mechanism)
131 tool holder
133 pressure control passage
134 filter unit
135 filter housing case
136 filter
137 case cover
140 striking element (driving mechanism)
141 cylinder
141*a* air chamber
143 striker
145 impact bolt
150 second crank mechanism (mechanical vibration mechanism)
151 second crank shaft
153 eccentric shaft
155 rod
157 disc
157*a* recess
160 dynamic vibration reducer
161 weight
163F, 163R biasing spring
165 slide sleeve
165*a* flange
167 ring-like member
170 electric component housing case
171 controller (electric component)
172 current supply cable
173 electric switch (electric component)
177 switch operation member

181 carbon brush holder
183 carbon brush
185 brush holder housing region
187 opening
191 cylindrical part
191*a* projection
193 screw
195 screw
211 slide guide (guide part)
213 shaft holding part
213*a* screw hole
214 spring receiver
215 guide shaft
215*a* male screw
215*b* protruding portion
217 slide cylinder
217*a* bore
219 compression coil spring (elastic element)
221 elastic ring
223 stopper
223*a* rear stopper
223*b* front stopper
225 side grip mounting part
227 iron sleeve
230 side grip
231 mounting ring
233 grip part
235 operation member

What we claim is:

1. An impact tool comprising:

a motor, a driving mechanism that is driven by the motor and drives a tool accessory at least in an axial direction of the tool accessory, a body housing that houses the motor and the driving mechanism, an outer housing that is disposed to cover an outside of the body housing, a handle that is fixedly connected to the outer housing; and an elastic element that is disposed between (1) the body housing and (2) the outer housing and handle such that the outer housing and the handle can move with respect to the body housing in the axial direction of the tool accessory, wherein:

a part of the motor and a part of the handle are disposed on an axis of the tool accessory, the body housing has an exposed region in which at least part of a region of the body housing corresponding to at least one of the motor and the driving mechanism is not covered by the outer housing.

2. The impact tool as defined in claim 1, wherein the exposed region of the body housing has an outer surface region that is formed flush with an outer surface of the outer housing.

3. The impact tool as defined in claim 1, wherein part of the outer housing can be removed from the body housing and a region of the body housing other than the exposed region is exposed by removing said part of the outer housing.

4. The impact tool as defined in claim 3, wherein:

the outer housing has a first housing and a second housing formed separately from the first housing, and at least one of the first housing and the second housing is removably connected to the body housing.

5. The impact tool as defined in claim 4, wherein:

the driving mechanism has a motion converting mechanism that converts rotation of the motor into linear motion, the motion converting mechanism has a rotation transmitting mechanism that transmits rotation of the motor to a rotation axis of the motion converting mechanism, the body housing has a motion converting mechanism housing part that houses the motion converting mechanism and a rotation transmitting mechanism housing part that houses the rotation transmitting mechanism, the motion converting mechanism housing part has a vent passage that communicates an inside and an outside of the motion converting mechanism housing part, and an air filter that is disposed in the vent passage, the rotation transmitting mechanism housing part is exposed when the first housing is removed from the body housing, and the air filter is exposed when the second housing is removed from the body housing, and the handle is removably connected to at least one of the first housing and the second housing, and electric components relating to driving of the motor are exposed when the handle is removed from at least one of the first housing and the second housing.

6. The impact tool as defined in claim 1, wherein the body housing has a barrel that houses part of the driving mechanism, the outer housing has a barrel cover that covers the barrel, and a side handle mounting part to which a side handle can be mounted is formed on the barrel cover.

7. The impact tool as defined in claim 1, further comprising a guide part that guides the outer housing and the handle with respect to the body housing in the axial direction of the tool accessory, wherein the guide part includes a first sliding part formed in the body housing and a second sliding part formed in the handle.

8. The impact tool as defined in claim 1, further comprising a weight that moves linearly in the axial direction of the tool accessory during hammering operation in which the tool accessory is driven in the axial direction, thereby reducing vibration caused in the body housing during the hammering operation.

9. The impact tool as defined in claim 1, further comprising:

a dynamic vibration reducer including (1) an elastic member and (2) a weight which is acted upon by a biasing force of the elastic member and can linearly move, wherein, by movement of the weight in the axial direction of the tool accessory, the dynamic vibration reducer reduces vibration caused in the body housing during hammering operation, and a mechanical vibration mechanism that actively drives the weight by applying an external force other than vibration of the body housing to the weight via the elastic member during hammering operation.

10. The impact tool as defined in claim 1, wherein:

the outer housing comprises upper and lower covers;

each of the upper and lower covers has a first longitudinal edge along the axial direction of the tool accessory; and the exposed region is between the first longitudinal edges of the upper and lower covers.

11. The impact tool as defined in claim 10, wherein:

the handle has a first end and a second end;

the first end and the second end being on opposite sides of the axis of the tool accessory; and the first end is fixedly attached to the upper cover and the second end is fixedly attached to the lower cover.

12. The impact tool as defined in claim 10, wherein:

the upper and lower covers are spaced apart;

each of the upper and lower covers has a second longitudinal edge along the axial direction of the tool accessory; and the first longitudinal edges of the upper and lower covers are on the opposite side of the axis of the tool accessory from the second longitudinal edges of the upper and lower covers.

13. The impact tool as defined in claim 10, wherein the upper and lower covers have symmetrical shapes with regard to the exposed region.

14. The impact tool as defined in claim 1, wherein portions of the body housing immediately adjacent to the motor and a part of the driving mechanism are included in the exposed region.

15. The impact tool as defined in claim 1, wherein:

the motor has an axis of rotation that is orthogonal to the axis of the tool accessory; and the exposed region overlaps the axis of the tool accessory in a direction orthogonal to the axis of rotation of the motor and orthogonal to the axis of the tool accessory.

* * * * *